United States Patent [19]

Wilde

[11] Patent Number: 4,729,715

[45] Date of Patent: Mar. 8, 1988

[54] VARIABLE INLET FOR A RADIAL TURBINE

[76] Inventor: Geoffrey L. Wilde, Hunter's Moon, Turnditch Derby, England

[21] Appl. No.: 886,221

[22] Filed: Jul. 16, 1986

[30] Foreign Application Priority Data

Jul. 17, 1985 [GB] United Kingdom ..... 8518044
Oct. 5, 1985 [GB] United Kingdom ..... 8524633

[51] Int. Cl.[4] ..... F01D 17/18

[52] U.S. Cl. ..... 415/150; 415/159; 415/205

[58] Field of Search ..... 415/126–128, 415/148, 150, 151, 157, 149 R, 158, 159, 162, 163, 160, 164, 165, 166, 205; 60/602, 606

[56] References Cited

U.S. PATENT DOCUMENTS

| | | | |
|---|---|---|---|
| 2,921,431 | 1/1960 | Sampietro | 60/606 |
| 2,944,786 | 7/1960 | Angell et al. | 415/148 X |
| 4,177,005 | 12/1979 | Bozung et al. | 415/151 X |
| 4,324,526 | 4/1982 | Berchtold et al. | 415/158 X |
| 4,391,564 | 7/1983 | Garkuska et al. | 415/126 |
| 4,492,520 | 1/1985 | Marchand | 415/152 R X |
| 4,565,068 | 1/1986 | Schneider | 415/205 X |

FOREIGN PATENT DOCUMENTS

| | | | |
|---|---|---|---|
| 0043305 | 1/1982 | European Pat. Off. . | |
| 0096624 | 12/1983 | European Pat. Off. . | |
| 2151658 | 4/1973 | Fed. Rep. of Germany | 60/602 |
| 2285514 | 4/1976 | France | 60/602 |
| 58-113884 | 1/1985 | Japan | 415/151 |
| WO82/0006-86 | 3/1982 | PCT Int'l Appl. . | |
| 1182832 | 3/1970 | United Kingdom . | |
| 1379075 | 1/1975 | United Kingdom . | |
| 2100359 | 12/1982 | United Kingdom . | |
| 2143591 | 2/1985 | United Kingdom . | |

*Primary Examiner*—Robert E. Garrett
*Assistant Examiner*—Joseph M. Pitko
*Attorney, Agent, or Firm*—Cushman, Darby & Cushman

[57] ABSTRACT

A supercharger for an internal combustion engine has a turbine driven compressor. The turbine is driven by the exhaust gases and is mounted in a volute casing. The volute casing has an internal flow passage which has an inlet and the passage is arranged to receive and discharge a flow of motive gases. The passage is partly defined by one or more movable wall members. The or each wall member is movable to vary the passage area whilst allowing the whole of the flow of motive gas to flow through the passage. Two movable wall members can be provided operated by a common linkage and the volute casing can have two inlets to receive the exhaust gases from separate manifolds of an internal combustion engine.

8 Claims, 11 Drawing Figures

VARIABLE INLET FOR A RADIAL TURBINE

Figure 1:
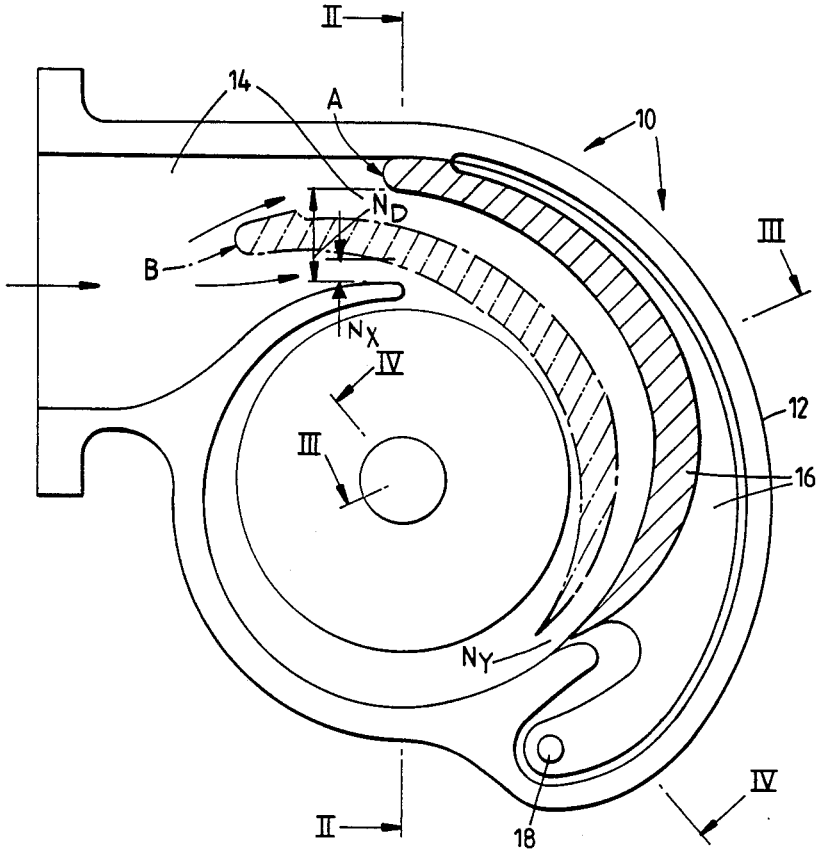

This invention relates to a variable inlet for a radial turbine, in which, for example, the radial turbine is used to drive the compressor of a vehicle engine turbo charger. The radial turbine is driven by the engine exhaust gases and the flow of gases has to be regulated to control the compressor speed and thus the engine manifold pressure. In existing turbochargers, radial turbines are provided with simple scroll cases (or volutes) which turn the engine exhaust gas into a circular motion or vortex flow to impinge upon the tips of the blades of the turbine rotor. The angular momentum of the gas so generated is absorbed by the rotor, thus developing the driving torque required for the turbocharger compressor. The outlet vanes of the rotor generate further torque by turning the gas through an angle of approximately 60 degrees within the rotor in the opposite sense to that of the turbine rotation. Thus the radial turbine rotor is a reaction turbine, a pressure drop occuring in the flow from the rotor vane tip to the outlet vane exit into the exhaust duct. The flow capacity of these turbocharger turbines is a function of the casing volute areas, the rotor tip area and the passage areas through the turbine rotor particularly the total outlet throat area of the rotor exit vane passages.

It is common practice for turbocharger speeds and gas flows to be matched to the engine to give the required manifold pressure at some chosen fraction of maximum crank speed e.g. approximately 70% of maximum crankshaft speed. Above this crank speed the turbocharger speed is regulated by opening a gate valve that diverts part of the engine exhaust gas from the turbocharger turbine inlet into the turbine exhaust duct. The gate valve opening reduces the expansion ratio across the turbine and prevents the turbocharger overspeeding. The gate valve is opened to maintain a constant engine manifold boost pressure above the design speed up to the maximum engine crankshaft speed. The gate valve is a simple and effective device although its use represents a loss in available energy. As the crank shaft speed reduces below the 70% value, the turbocharger speed reduces and supercharge pressure falls thereby reducing engine torque. This state of affairs is clearly undesirable and reduces the performance potencial of the engine.

In applications where a high manifold boost pressure is required at the lower engine crank speeds the turbocharger would need sizing for a lower gas flow capacity. A much larger gate valve capacity would then be necessary to prevent the engine being subject to excessive exhaust back pressure at the higher crank speeds.

There would then be a flow and power mismatch between that required by the compressor to supercharge the engine and that required from the turbine to drive the compressor at the higher crank speeds. Also, the larger the gate valve flow, the lower will be the overall expansion efficiency on the exhaust side of the engine. Further, the engine is forced to operate at a higher exhaust back pressure than it would if all the gas passed through the turbine rotor.

These limitations can be overcome by incorporating a variable area turbine nozzle in the turbocharger.

The simple, mechanically effective, but not very efficient commercial radial turbine rotor has one nozzle orifice cast in the turbocasing followed by a volute type passage directing the gas onto 360° of rotor circumference.

In an application in which the turbine nozzle area may need to be reduced to as little as 25% of the design value, it is not considered satisfactory to do this by reducing the area of the nozzle orifice wholly at entry to the rotor. This is because the high velocity nozzle flow would then be local to a small fraction of the circumference of the rotor and the frictional losses of the nozzle flow would be such as to reduce the velocity with which the nozzle flow impinges on the rotor blading as the flow travels round the circumference of the rotor.

These limitations can be overcome by the introduction of a variable flow capacity turbine which would enable the expansion ratio across the turbine to be maintained at low engine crank shaft speeds and thus maintain turbocharger speed and engine supercharge pressure.

The present invention seeks to provide a way of avoiding the inefficiencies caused by the gate valve and the power limitations of a single variable area nozzle orifice placed only at the entry position to the rotor.

The present invention further seeks to provide a turbine casing and nozzle which will meet these objectives and can be adapted to suit existing turbochargers at a comparatively low cost.

In particular, the present invention provides a way whereby all of the turbine motive gases pass through the turbine rotor at all conditions.

Accordingly, the present invention provides a volute casing having an internal fluid flow passage, the passage having an inlet arranged to receive and discharge a flow of motive gases, the passage being partly defined by at least one movable wall member, the wall member being movable to vary the passage area whilst allowing the whole of the flow of motive gas to flow through the passage. The movable wall member can be in one piece and pivoted on a spindle actuated by a control rod.

The present invention further proposes the use of two or more movable wall members which are movable either together or independently to vary the flow passage area, whilst also allowing the whole flow of the motive gas to flow through the casing passages. In particular the present invention is proposed for incorporation into existing vehicle engine turbochargers without the need for major modification.

Figure 2:
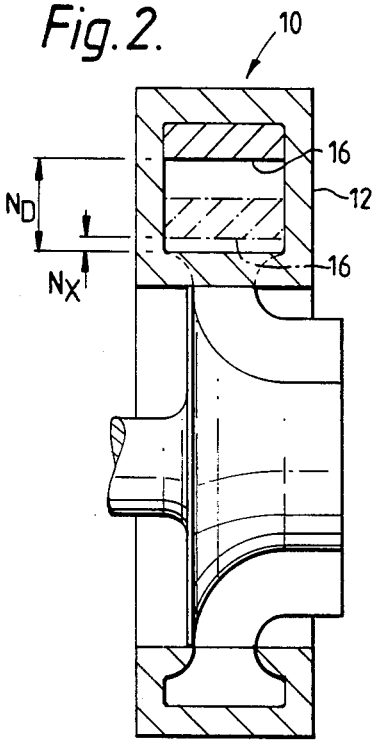
Figure 3:
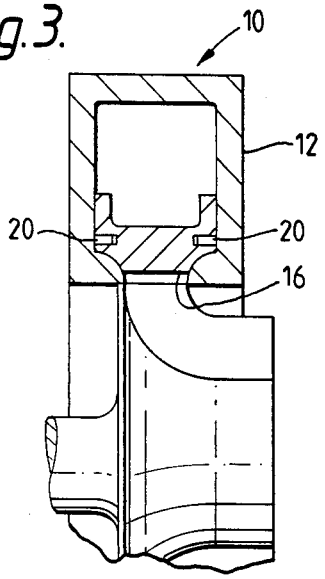
Figure 4:
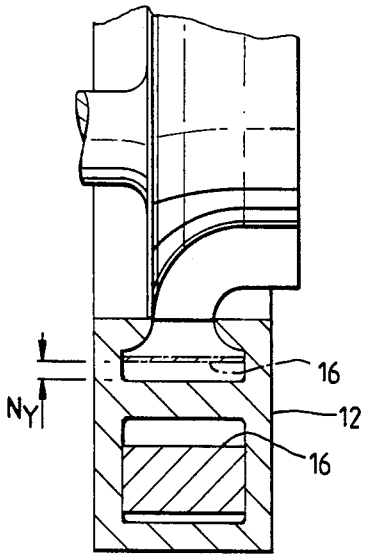
Figure 5:
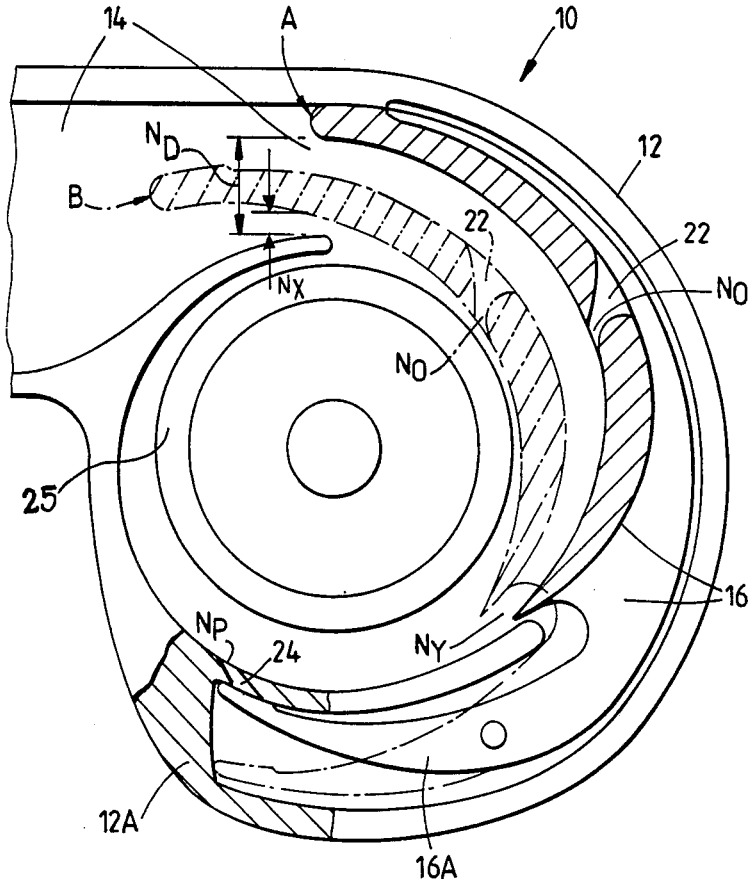
Figure 6:
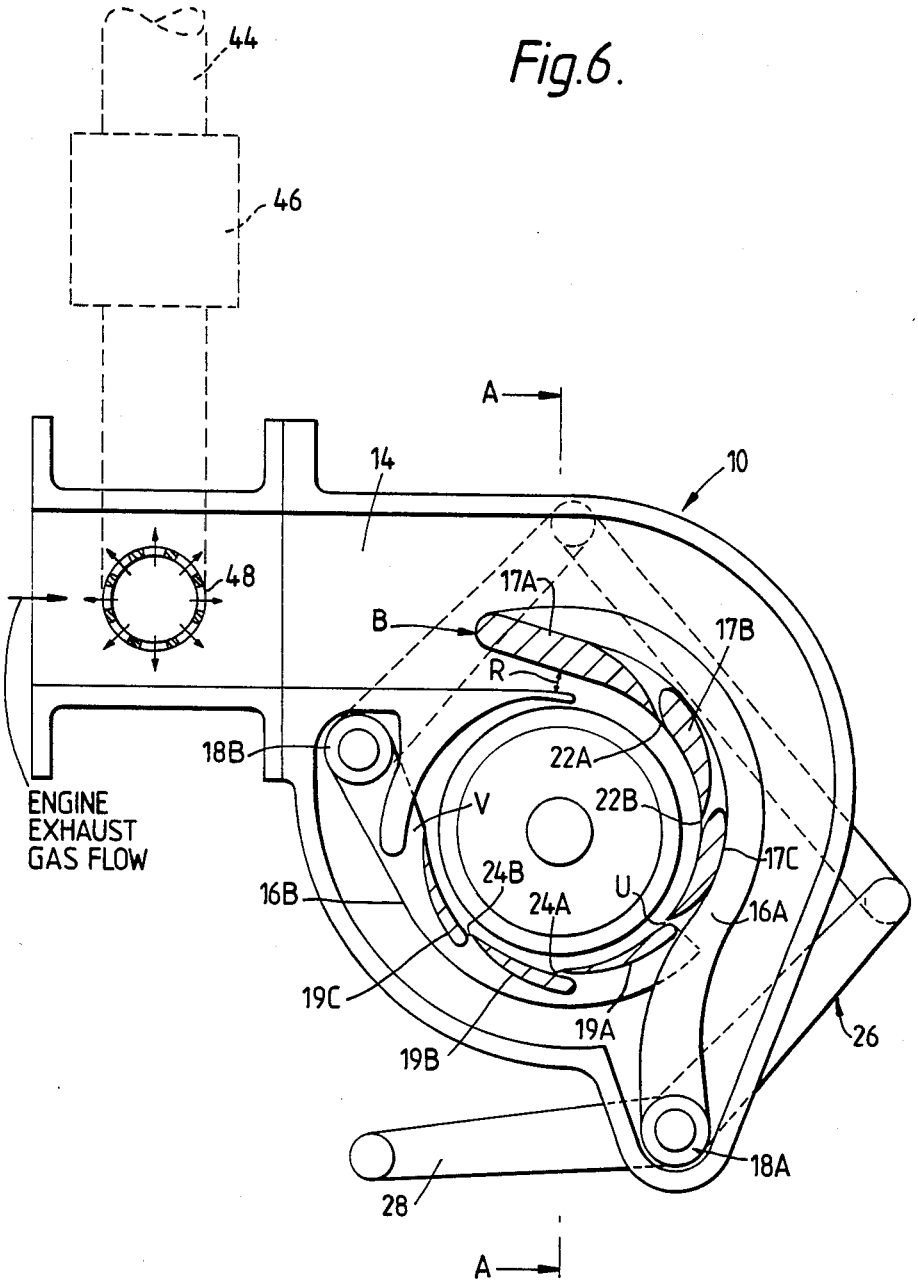
Figure 7:
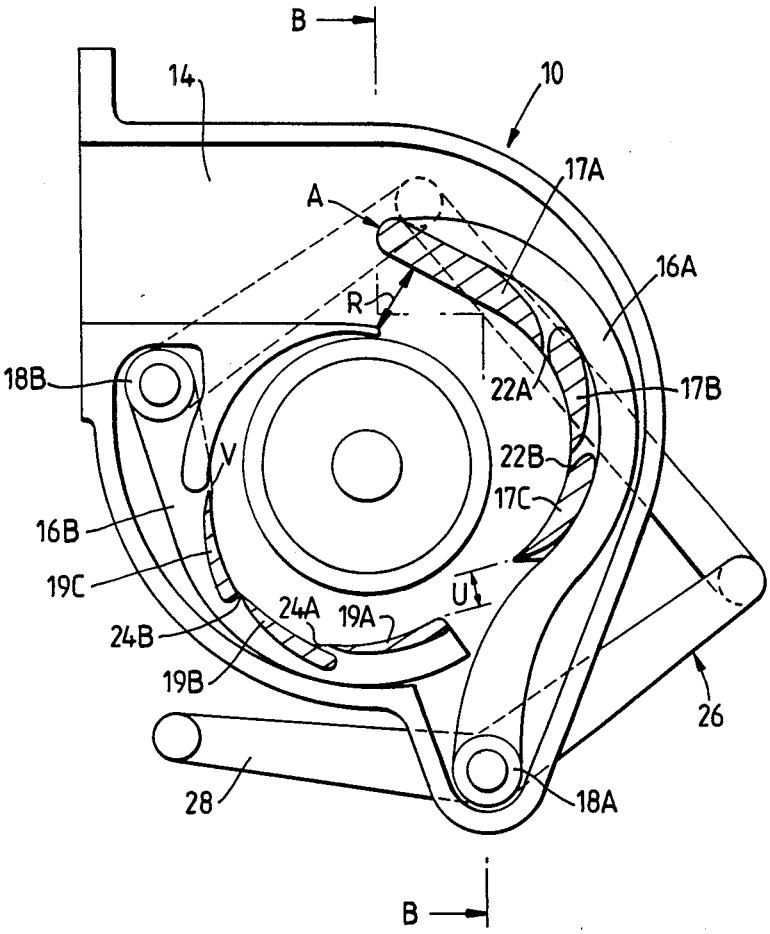
Figure 8:
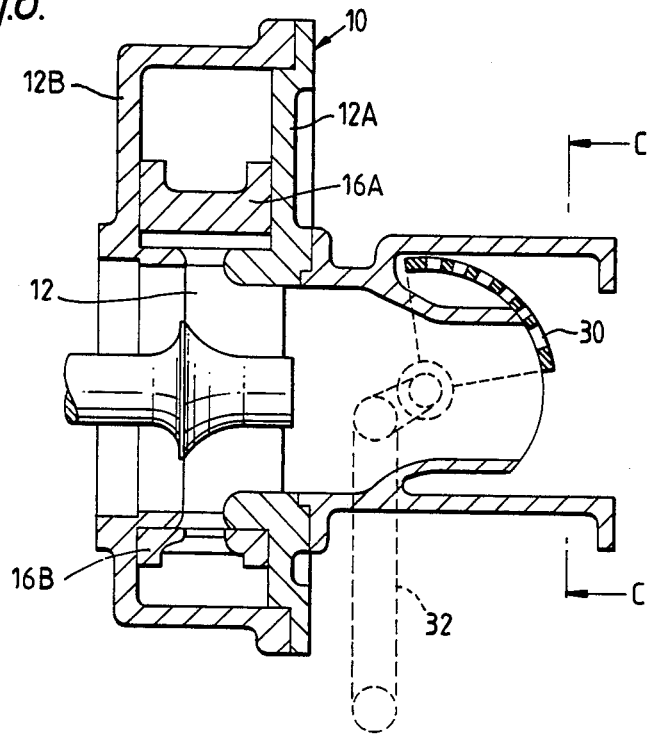
Figure 9:
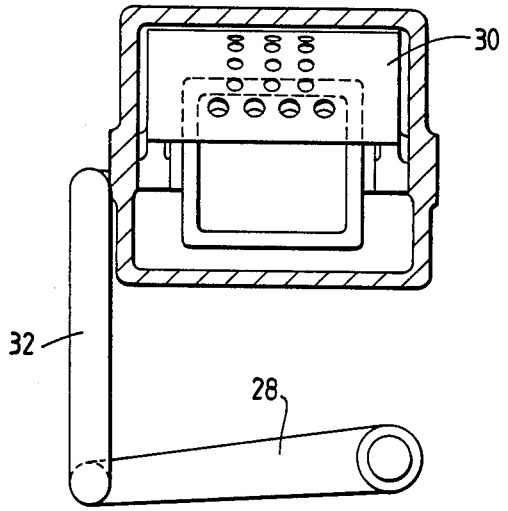
Figure 10:
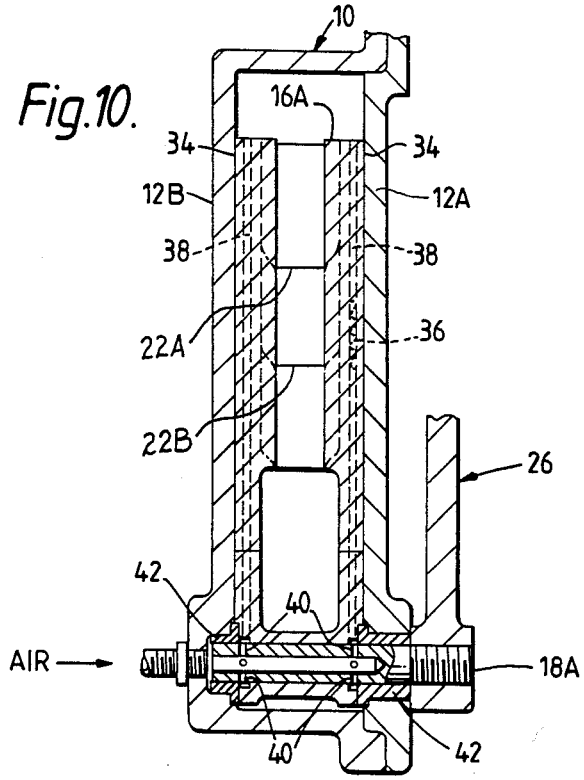
Figure 11:
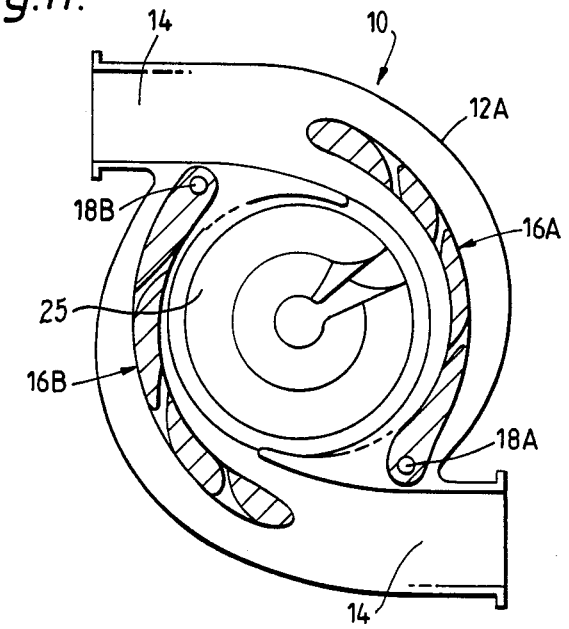

The present invention will now be more particularly described with reference to the accompanying drawings in which FIG. 1 shows one form of volute casing according to the present invention, FIG. 2 is a section on line 11—11 in FIG. 1, FIG. 3 is a section on line 111—111 in FIG. 1, FIG. 4 is a section on line IV in FIG. 1, FIG. 5 shows a further form of volute casing according to the present invention, FIG. 6 shows one form of volute casing according to the present invention having two movable wall members, FIG. 7 shows the volute casing of FIG. 6 with the movable wall members in a different position to that shown in FIG. 6, FIG. 8 is a section on line A—A in FIG. 6, FIG. 9 is a view on arrows C,C in FIG. 8, FIG. 10 is a view on the line B—B in FIG. 7 and FIG. 11 shows a further embodiment of a volute casing according to the present invention, having two inlets.

Referring to the drawings, a volute casing 10 for a radial turbine of vehicle turbocharger (not shown) comprises a casing 12 having an internal flow passage or nozzle 14. The flow passage 14 is arranged to receive motive gas for the turbine and to discharge the motive gas to the turbine rotor. In a vehicle the motive gas is usually the engine exhaust gas.

The passage 14 is partly defined by a movable wall member or vane 16 which is pivoted on a spindle 18, the remainder of the passage being defined by fixed parallel walls of the casing. The wall member has ceramic face seals 20 (FIG. 3) which seal against internal surfaces of the casing to minimise gas leakage.

The wall member 16 is movable progressively by a control rod (not shown) attached to the spindle 18 between a first position A (FIG. 1) and an illustrated second position B.

The wall member is in position A at engine crank speeds above the chosen fraction of the maximum crank speed selected to give the required engine manifold boost pressure.

At crank speeds below the chosen fraction, the wall member is moved progressively towards position B as the engine crank speed reduces. The nozzle inlet area reduces from $N_D$ (design area of nozzle) to $N_X$ but a secondary nozzle area ($N_Y$) is introduced so that the exhaust gases can flow around both sides of the wall member. This arrangement assists in distributing the gas flow around the circumference of the turbine rotor as the nozzle area ($N_X+N_Y$) is reduced, thereby helping to maintain the turbine efficiency over a wide range of gas flows.

All the air/gas passing through the turbocharger compressor and engine now passes through the turbine rotor at all conditions. As the compressor and turbine are properly matched as regards speed and flow, the usual gate valve becomes redundant. The gate valve could still be retained however for the purpose of fine tuning, or as an additional safeguard against turbocharger overspeeding.

Referring to FIG. 5 in the arrangement shown the volute casing has been modified as has also the movable vane 16. In particular the vane 16 has an extension 16A which is accomodated in an extension 12A to the casing 12. Also the vane 16 has a passage 22 intermediate between the front and rear of the vane, the passage having a nozzle area $N_O$. The extension 12A of the casing 12 has a passage 24 having a nozzle area $N_P$. The flow through this passage being controlled by the extension 16A of the vane 16 as will be described.

The wall member 16 and thus its extension 16A is in position A at engine crank speeds above the chosen fraction of the maximum crank speed selected to give the required engine manifold pressure as was the case in the embodiment already described. In this position there is no flow through the passage 22 and the extension 16A of the vane 16 closes off passage 24 and thus there is no flow through this passage either. Thus in this position, as far as operating conditions are concerned this embodiment is very similar to the previous embodiment.

As the vane moves towards position B the area $N_X$ reduces and the flow through $N_O$ increases in the proportion to the pressure drop across the vane 16. The nozzle area $N_Y$ is introduced and the nozzle area $N_P$ is also introduced by the vane 16 uncovering the passage 24.

In this arrangement two further nozzle areas are introduced $N_O$ and $N_P$, which further aid in distributing the gas flow around the circumference of the turbine rotor.

Thus is it arranged that the turbocharger radial flow turbine operates in the conventional manner when the movable vane 16 is in position A (FIGS. 1 and 5), the gas velocity impinging onto the rotor vanes 25 as determined by the gas vortex flow developed inside the scroll casing, but differently when the movable vane 16 is in positions such as B (FIGS. 1 and 5). In this case the rotor vanes 25 are impinged upon and driven by the two gas nozzle flows from nozzle areas $N_X$ and $N_Y$ (FIG. 1) or the four gas nozzle flows from the nozzle areas $N_X$; $N_O$; $N_Y$; $N_P$ (FIG. 5).

A further possible nozzle configuration is shown in FIGS. 6—10. A volute casing 10 for a radial turbine 12 of a vehicle engine turbocharger (not shown) has an internal entry flow passage 14. The flow passage 14 is arranged to receive motive gas for the turbine from the vehicle engine and to discharge the motive gas to the inlet of the turbine rotor, as described previously. In a vehicle the motive gas is usually the engine exhaust gas.

Downstream of entry passage 14 the flow areas are partly defined by two movable wall members or segmenet 16A, 16B which are pivoted respectively on spindles 18A and 18B, the remainder of the passage being defined by fixed parallel walls 12A, 12B of the casing. Each segment 16A and 16B incorporates nozzle vane elements 17A, 17B, 17C and 19A, 19B, 19C respectively. The vane elements of segment 16A define fixed area nozzles 22A and 22B and the vane elements in segment 16B define fixed area nozzles 24A and 24B. The vane segment 16A has a variable area inlet R and the vane segment 16B has a variable area outlet V, and there is a variable area passage U between the vane segments, 16A, 16B.

The vane segments 16A and 16B are shown connected together by a three element link system 26 which can be operated by a lever 28 so that upon movement of the lever 28 both vane segments will pivot on their respective spindles and the variable areas R, U and V will be altered to control the speed of the radial turbine 12. As an alternative a cam and lever system could be used to regulate the movements of segments 16A and 16B.

As shown the nozzle segments are actuated through the lever 28 and link mechanism 26 to regulate the turbocharger speed in order to maintain the required engine supercharged pressure from 100% of crankshaft speed down to about 25% of maximum engine crankshaft speed.

The provision of the two vane segments enables a series of nozzles to be introduced immediately upstream of the turbine rotor of much reduced flow area at low engine crankshaft speeds compared with the volute casing area. FIG. 6 shows the two vane segments in position B which corresponds to the minimum engine crankshaft speed. In FIG. 7 the two vane segments are in position A which corresponds to the maximum engine crankshaft speed and the turbine rotor operates with vortex flow as in the current turbochargers.

The motive gas flows both through the fixed area nozzles of the vane segments 16A, 16B and through the variable area passage, inlets and outlets. The whole of the motive gas flows through the casing 10 of the turbine 12, and none flows out through a waste gate valve bypassing the turbine. A throttle valve 30 (FIG. 8) is incorporated in the casing downstream of the turbine to enable the levels of pressure at inlet and outlet of the turbine to be raised to reduce the volumetric flow of gas through the turbine should this be found to be necessary when adapting a particular design and size of turbine rotor to match the chosen engine gas flow.

The valve 30 is of the Corlis type with a graded flow resistence to raise the density of the exhaust gas should this be necessary if the flow passage areas of the turbine were found not to be large enough to pass the full exhaust flow at the high engine speeds. The valve 30 is linked to the lever 28 by linkage 32 so that the valve 30 is operated synchronously with the vane segments.

Referring to FIG. 10, the vane segment 16A (and the vane segment 16B is similar) has ceramic face seals 34 held in contact with the inside of the casing walls 12A. 12B by springs 36. The segments 16A and 16B also have cooling channels 38 fed by air beld from the engine boost pressure supply and passed through the interior of the spindle 18A and leaving through outlets 40 in the spindle. The spindle itself is mounted in ceramic bushes 42 in the casing.

It may happen, depending on the lowest chosen crankspeed at which the full supercharge pressure is to be maintained that the flow through the compressor of the turbocharger is less than the minimum stable flow. In that case it may be necessary to divert a proportion of the compressor delivery air to the turbine inlet. This can be achieved by the provision of bleed duct 44, a valve 46 and a mixing nozzle 48 (FIG. 6). The valve 46 can be operated by a signal which may be a predetermined value of the difference between the supercharge pressure to the engine and the exhaust gas pressure at the turbine inlet.

Referring to FIG. 11, in which similar components have been given reference numerals corresponding to those used in previous figures, the casing 10 has two internal passages 14. Each passage 14 is arranged to receive the exhaust flow from one bank of cylinders of an engine having two banks of cylinders, each bank having a separate exhaust manifold. The casing includes two segments 16A, 16B which are constructed and arranged to control the gas flow in a similar manner to that described with references to FIGS. 6 to 10.

The present invention provides a means of controlling the speed of a vehicle engine turbocharger enabling the maximum output torque of the engine to be maintained or even passibly increased as the engine crankshaft speed is reduced from maximum RPM down to about 25% of maximum RPM with a minimum wastage of fuel. This is achieved by making the most efficient use of the available engine exhaust gas energy and not to bleed turbocharge compressor flow or engine exhaust flows directly to atmosphere just to match turbocharger flow limitations to engine flows.

In the case of adapting existing turbochargers it will only be necessary to provide a different volute casing to accomodate the movable wall members and this can be provided by either a new casting or by fabricating a new casing without making any other changes to the turbocharger rotor systems or compressor unit.

I claim:

1. A turbine apparatus comprising a volute casing having an internal flow passage for receiving and passing a driving medium to a turbine rotor connected to said passage, said passage having at least one inlet and one outlet, said passage being partly defined by at least one movable wall member, the wall member being movable to vary the area of the inlet between a first position in which the inlet area is at a maximum and further positions in which the inlet area is less than the maximum to allow the driving medium to flow over both surfaces of the wall member and to flow onto the surface of a turbine rotor at, at least, two locations angularly displaced with respect to one another when the movable wall member is located at any one of said further positions, said movable wall member having at least one opening defining a fixed area nozzle to allow the passage therethrough of a portion of the driving medium.

2. A volute casing according to claim 1 having two movable wall members, the wall members being movable to vary the flow passage area within the volute casing whilst allowing the whole of the flow of the motive gas to flow through the casing passge.

3. A volute casing according to claim 1 in which the wall member is pivotally mounted and is operable by a control mechanism.

4. A volute casing as claimed in claim 1 having a throttle valve located downstream of the outlet of the volute casing to provide control of the pressures at the inlet and outlet of the casing.

5. A volute casing as claimed in claim 1 in which the wall member has face seal means in contact with the internal surface of the volute casing.

6. A volute casing as claimed in claim 1 in which the wall member has a cooling channel arranged to receive a flow of cooling medium.

7. A volute casing as claimed in claim 1 having a bleed duct arranged to receive compressed air into the internal passage of the volute casing.

8. A volute casing as claimed in claim 1 in which the casing has two inlets each inlet being arranged to receive the exhaust gases from separate exhaust manifolds of an internal combustion engine.

* * * * *